US009769571B2

(12) United States Patent
Asano et al.

(10) Patent No.: US 9,769,571 B2
(45) Date of Patent: Sep. 19, 2017

(54) LOUDSPEAKER AND ELECTRONIC APPARATUS USING THE LOUDSPEAKER

(71) Applicant: Panasonic Intellectual Property Management Co., Ltd., Osaka (JP)

(72) Inventors: Akira Asano, Mie (JP); Mitsutaka Enomoto, Nara (JP); Tomoyuki Matsunaga, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/841,786

(22) Filed: Sep. 1, 2015

(65) Prior Publication Data

US 2015/0373457 A1 Dec. 24, 2015

Related U.S. Application Data

(63) Continuation of application No. PCT/JP2014/001162, filed on Mar. 4, 2014.

(30) Foreign Application Priority Data

Mar. 8, 2013 (JP) ..... 2013-046313

(51) Int. Cl.
*H04R 1/00* (2006.01)
*H04R 9/06* (2006.01)
(Continued)

(52) U.S. Cl.
CPC ..... *H04R 9/025* (2013.01); *H04R 9/06* (2013.01); *H04R 2499/11* (2013.01)

(58) Field of Classification Search
CPC ..... H04R 9/025; H04R 9/06; H04R 2499/11
(Continued)

(56) References Cited

U.S. PATENT DOCUMENTS 4,471,172 A * 9/1984 Winey ..... H04R 9/047 381/412
2006/0050922 A1* 3/2006 Tomoeda ..... H04R 9/025 381/412

(Continued)

FOREIGN PATENT DOCUMENTS

JP 2003-032786 1/2003
JP 2004-343602 12/2004

(Continued)

OTHER PUBLICATIONS

International Search Report of PCT application No. PCT/JP2014/001162 dated May 20, 2014.

*Primary Examiner* — Duc Nguyen
*Assistant Examiner* — Sean H Nguyen
(74) *Attorney, Agent, or Firm* — McDermott Will & Emery LLP

(57) ABSTRACT

A loudspeaker includes two first magnetic portions arranged in parallel and a second magnetic portion disposed between the two first magnetic portions on a bottom plate. An annular top plate is provided to the two first magnetic portions and disposed in such a manner as to form a magnetic gap with respect to the second magnetic portion. The first magnetic portions and the second magnetic portion are magnetized in the opposite directions in a direction in which the bottom plate, the first magnetic portions and the top plate are stacked. The top plate includes two main bodies provided to the two first magnetic portions and two bending portions connecting between two first magnetic portions and bending toward the bottom plate.

16 Claims, 6 Drawing Sheets

(51) Int. Cl.
*H04R 11/02* (2006.01)
*H04R 9/02* (2006.01)

(58) Field of Classification Search
USPC ..... 381/412
See application file for complete search history.

(56) References Cited

U.S. PATENT DOCUMENTS

| | | | | |
|---|---|---|---|---|
| 2007/0165902 | A1 | 7/2007 | Matsumura et al. | |
| 2008/0309440 | A1 | 12/2008 | Itakura | |
| 2011/0255734 | A1* | 10/2011 | Marugami | H04R 9/025 381/398 |
| 2012/0177246 | A1* | 7/2012 | Shi | H01F 7/0289 381/398 |
| 2012/0314898 | A1* | 12/2012 | Sorensen | H04R 9/063 381/412 |
| 2013/0259289 | A1* | 10/2013 | Zhang | H04R 9/025 381/412 |
| 2014/0376766 | A1* | 12/2014 | Chen | H04R 9/02 381/400 |

FOREIGN PATENT DOCUMENTS

| | | |
|---|---|---|
| JP | 2008-148218 | 6/2008 |
| JP | 2008-312056 | 12/2008 |
| WO | 2004/068899 | 8/2004 |
| WO | 2006/080405 | 8/2006 |

* cited by examiner

LOUDSPEAKER AND ELECTRONIC APPARATUS USING THE LOUDSPEAKER

BACKGROUND OF THE INVENTION

1. Technical Field

The present invention relates to a loudspeaker used for a portable telephone and other various electronic apparatuses, and to electronic apparatuses using the loudspeaker.

2. Background Art

In various electronic apparatuses such as mobile communication apparatuses represented by a portable telephone, improvement in performance and functions is demanded. In addition, for the purpose of improving convenience such as portability, electronic apparatuses are required to be smaller, more lightweight, and more compact.

In such a background, it is becoming essential for also loudspeakers and receivers mounted in various electronic apparatuses to have an improved space factor and to be smaller, more lightweight, and more compact, while high performance and low cost are maintained.

A conventional loudspeaker is described with reference to FIG. 13. FIG. 13 is a perspective view of magnetic circuit 24 of a conventional loudspeaker. Magnetic circuit 24 includes bottom plate 23, and a plurality of magnets 22A, 22B, and 22C coupled to bottom plate 23, and top plates 21A, 21B, and 21C coupled to magnets 22A, 22B, and 22C, respectively, at the opposite side to bottom plate 23.

Herein, a magnetic gap includes linearly extending magnetic gaps 25A and 25B. A voice coil wound in a track shape or a rectangular shape, is inserted into magnetic gaps 25A and 25B. A magnetization direction of magnets 22A and 22B disposed at the outer side of the voice coil and a magnetization direction of magnet 22C disposed at the inner side of the voice coil are different from each other. This configuration of magnetization directions allow magnetic energy of neighboring magnets to be synthesized, and a magnetic flux density at the inner side of the magnetic gaps to be improved. Thus, a sound pressure level of the loudspeaker can be enhanced.

Magnetic circuit 24 configured above is coupled to a frame. The frame supports a diaphragm such that the voice coil fixed to the diaphragm is inserted into magnetic gaps 25A and 25B of magnetic circuit 24.

Herein, in order to improve the space factor, this loudspeaker has a noncircular outside shape such as an elliptic shape or a track shape or a rectangular shape. Magnetic circuit 24 also has a noncircular outside shape such as an elliptic shape or a track shape or a rectangular shape, corresponding to the outside shape of the loudspeaker.

Herein, the magnetic gaps are formed in a portion provided with magnets at outer and inner sides thereof. Furthermore, for the purpose of enhancing a sound pressure level of the loudspeaker, a magnetic circuit, in which a magnetic gap is provided in a portion provided with a magnet only at the inside by bending a bottom plate, has also been proposed.

Note here that the prior art document relating to the invention of this application includes, for example, PTL 1.

CITATION LIST

Patent Literature

PTL 1: Japanese Patent Application Unexamined Publication No. 2008-148218

SUMMARY OF THE INVENTION

A loudspeaker of the present invention includes a magnetic circuit, a frame, a diaphragm, and a voice coil. The magnetic circuit includes a bottom plate, two first magnetic portions, a second magnetic portion, and an annular first top plate. The two first magnetic portions and the second magnetic portion are arranged in parallel and coupled to the bottom plate. The second magnetic portion is disposed between the two first magnetic portions. The first top plate is provided to the two first magnetic portions at an opposite side to the bottom plate, and is disposed in such a manner as to form magnetic gaps with respect to the second magnetic portion. The frame is coupled to the magnetic circuit. The diaphragm is supported by the frame. The voice coil is fixed to the diaphragm, and inserted into the magnetic gaps of the magnetic circuit. The two first magnetic portions and the second magnetic portion are magnetized in opposite directions to each other in a first direction in which the bottom plate, the first magnetic portions, and the first top plate are stacked. The first top plate includes two main bodies each of which is disposed on each of the first magnetic portions, and two bending portions connecting between the two first magnetic portions and bending toward the bottom plate from the main bodies.

With such a configuration, a magnetic utilization factor can be improved and a sound pressure level can be enhanced also in a noncircular-shaped magnetic circuit capable of making a loudspeaker smaller, more lightweight, and more compact.

DETAILED DESCRIPTION OF THE PREFERRED EMBODIMENT

Figure 13:
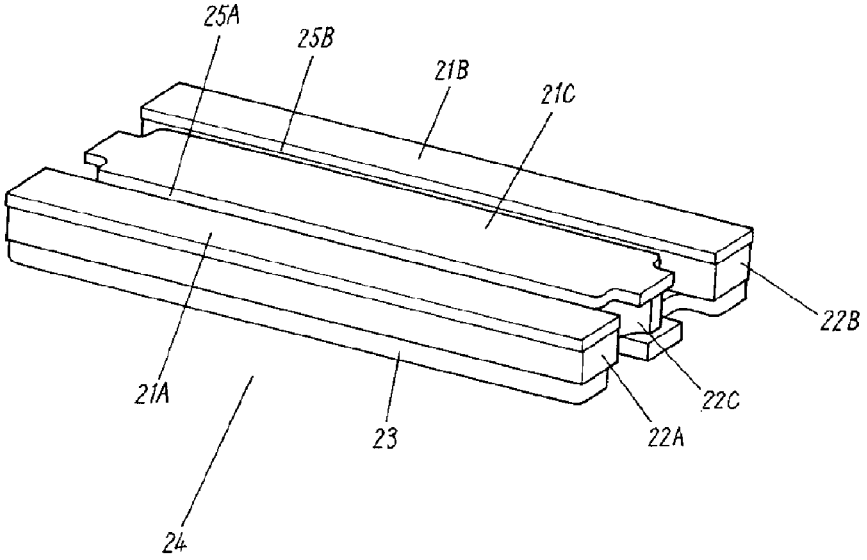
FIG. 13 PRIOR ART
FIG. 13 is a perspective view of a magnetic circuit of a conventional loudspeaker.

Prior to an exemplary embodiment of the present invention, problems of a loudspeaker using conventional magnetic circuit 24 shown in FIG. 13 are described. Demands from the market for making a loudspeaker smaller, more lightweight, and more compact, and reducing cost, lead to deterioration of a sound pressure level of the loudspeaker. In addition, in order to enhance the sound pressure level of the loudspeaker, a plurality of magnets and a plurality of top plates are used. Accordingly, many production man-hours including positioning or coupling of many components are required, resulting in increase in cost.

Hereinafter, a loudspeaker in accordance with an exemplary embodiment of the present invention is described with reference to drawings. In the loudspeaker, the above-mentioned problems can be dissolved, and a sound pressure level can be enhanced even when the loudspeaker is made smaller, more lightweight, and more compact, as well as cost reduction can be achieved.

Figure 1:
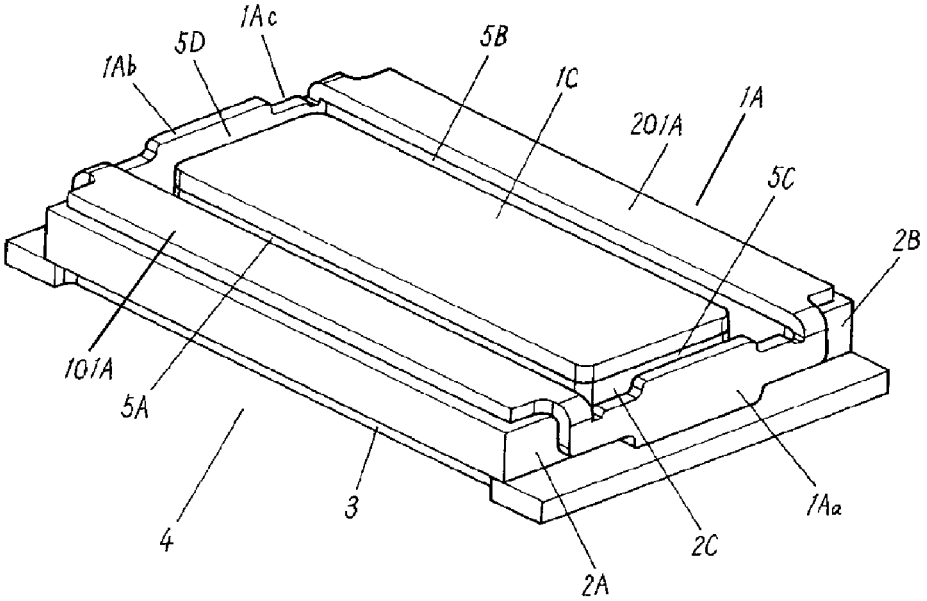
FIG. 1 is a perspective view of a magnetic circuit in accordance with an exemplary embodiment of the present invention.
Figure 2:
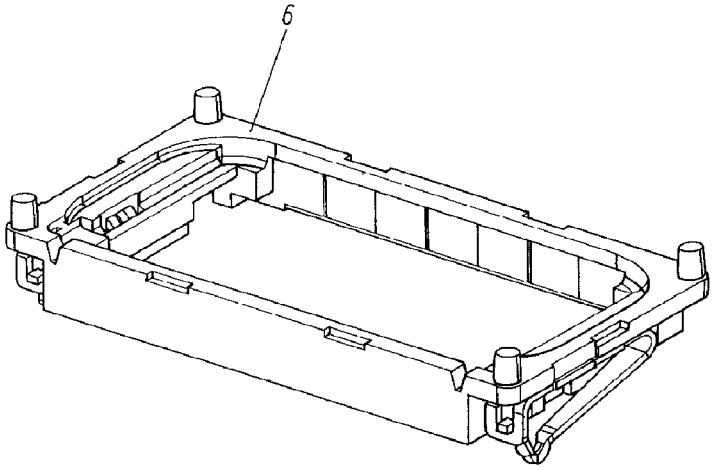
FIG. 2 is a perspective view of a frame in accordance with the exemplary embodiment of the present invention.
Figure 3:
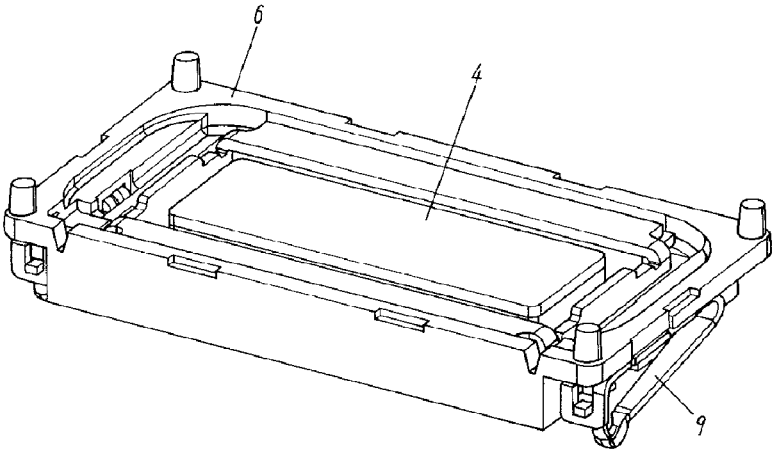
FIG. 3 is a perspective view of the frame supporting the magnetic circuit in accordance with the exemplary embodiment of the present invention.
Figure 4:
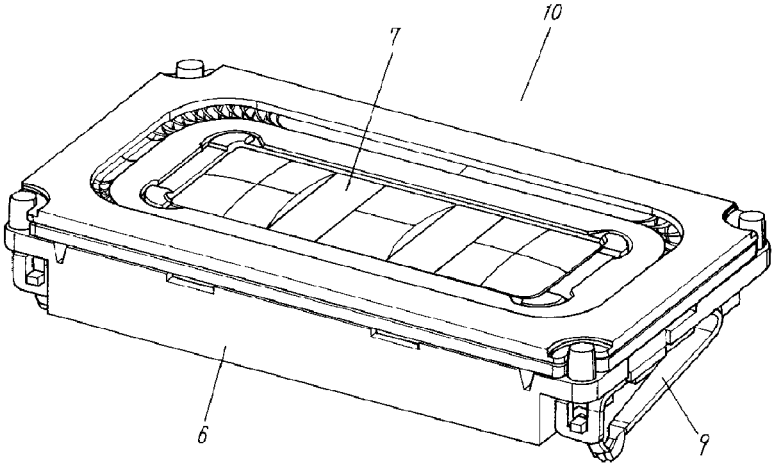
FIG. 4 is a perspective view of a loudspeaker in accordance with the exemplary embodiment of the present invention.
Figure 5:
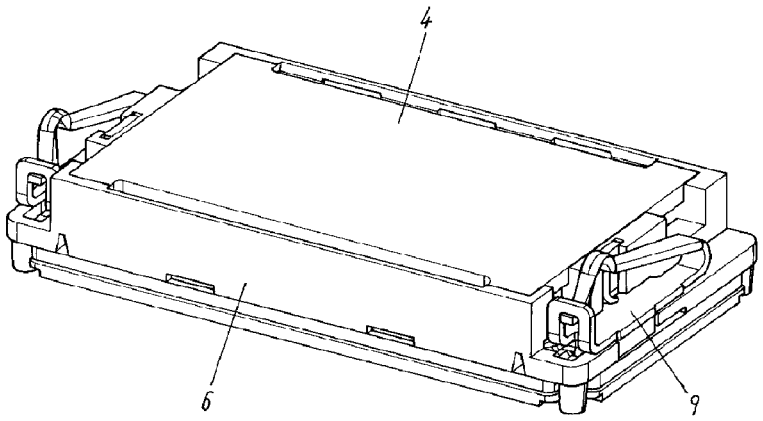
FIG. 5 is a perspective back view of the loudspeaker in accordance with the exemplary embodiment of the present invention.

FIG. 1 is a perspective view of a magnetic circuit of an exemplary embodiment of the present invention. FIG. 2 is a perspective view of a frame of the same exemplary embodiment. FIG. 3 is a perspective view of the frame supporting the magnetic circuit of the same exemplary embodiment. FIG. 4 is a perspective view of a loudspeaker of the same exemplary embodiment. FIG. 5 is a perspective back view of the loudspeaker of the same exemplary embodiment.

Figure 6:
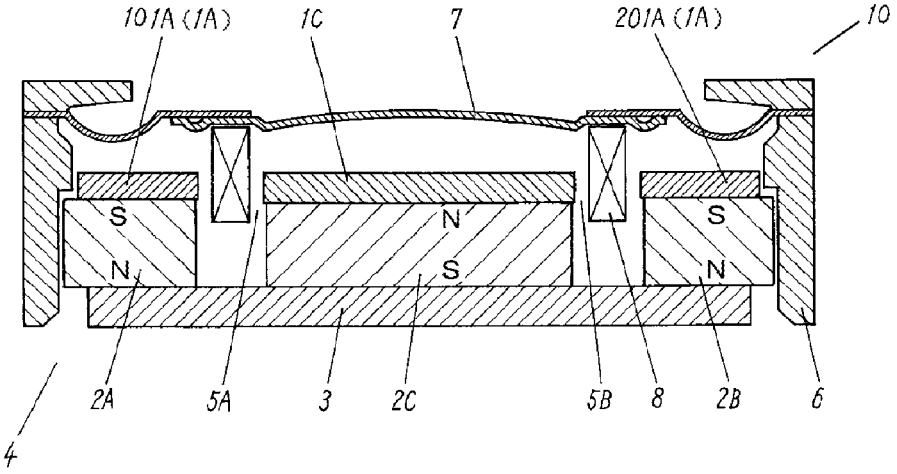
FIG. 6 is a sectional view in a short direction of the loudspeaker in accordance with the exemplary embodiment of the present invention.
Figure 7:
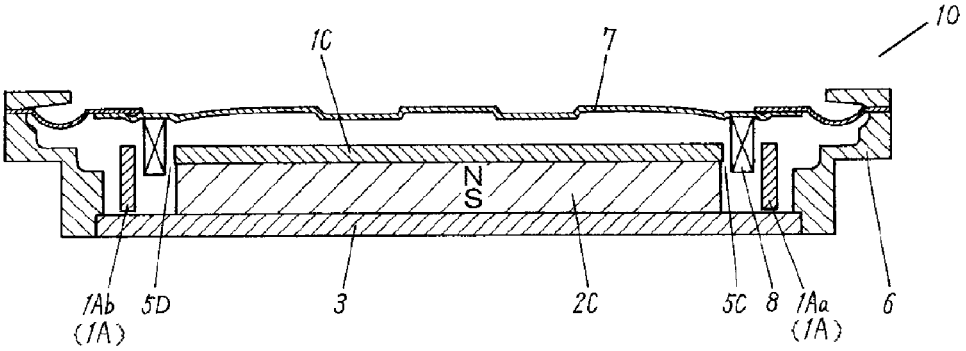
FIG. 7 is a sectional view in a longitudinal direction of the loudspeaker in accordance with the exemplary embodiment of the present invention.
Figure 8:
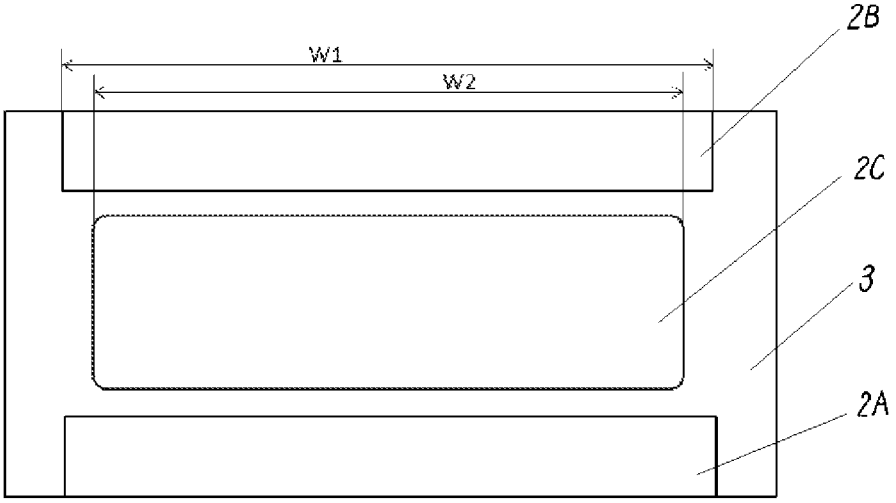
FIG. 8 is a top view of the loudspeaker in which a top plate is taken off from the magnetic circuit in accordance with the exemplary embodiment of the present invention.
Figure 9:
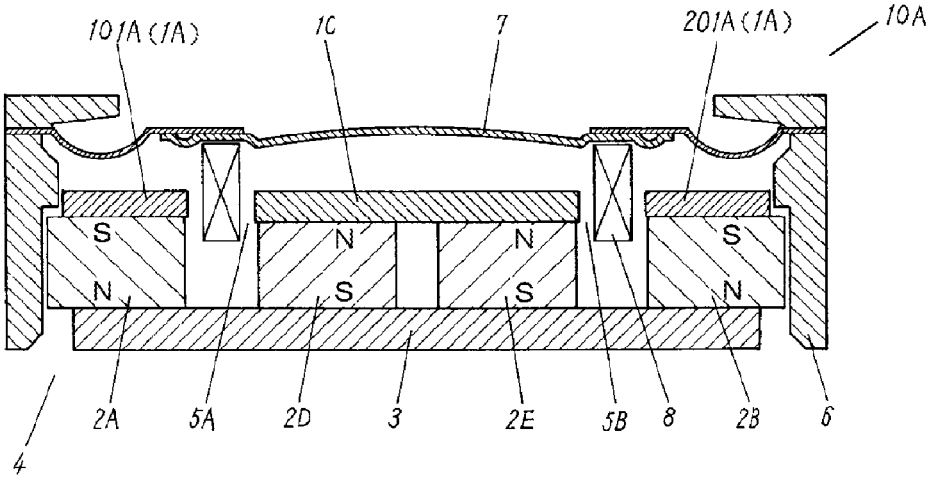
FIG. 9 is a sectional view in a short direction of another loudspeaker in accordance with the exemplary embodiment of the present invention.
Figure 10:
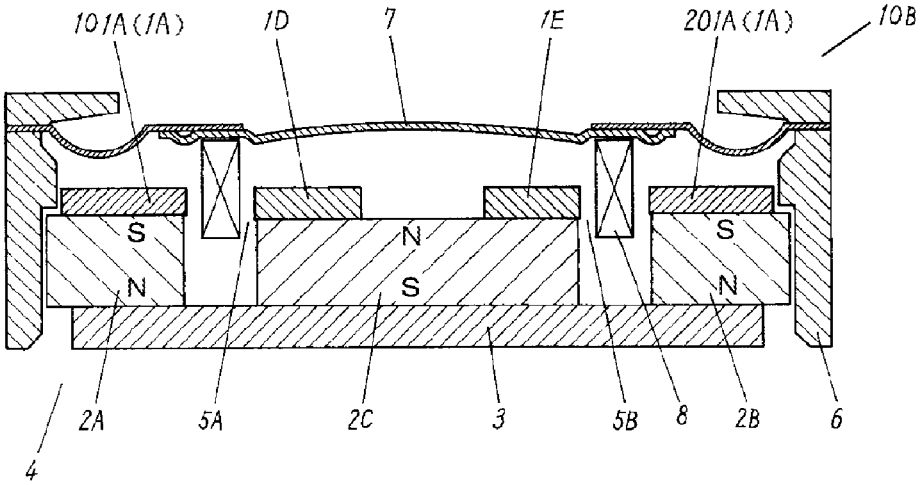
FIG. 10 is a sectional view in a short direction of still another loudspeaker in accordance with the exemplary embodiment of the present invention.
Figure 11:
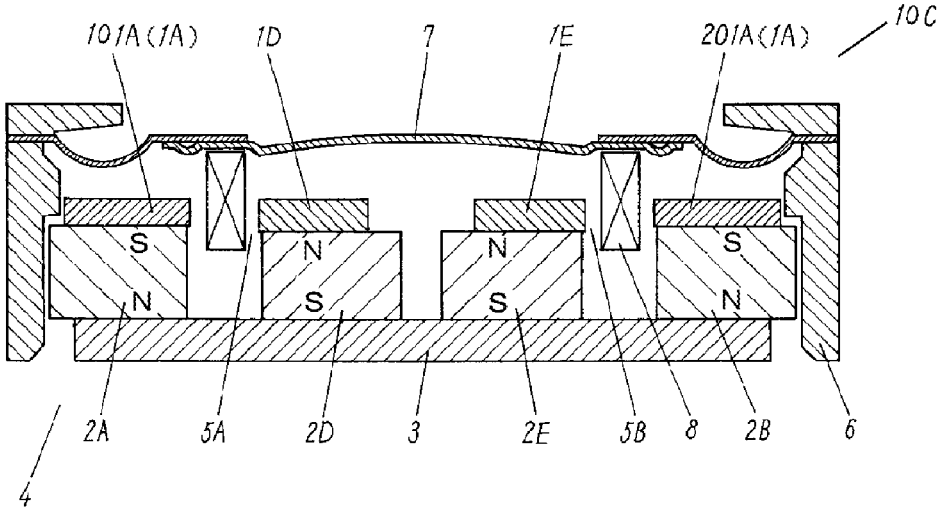
FIG. 11 is a sectional view in a short direction of yet another loudspeaker in accordance with the exemplary embodiment of the present invention.
Figure 12:
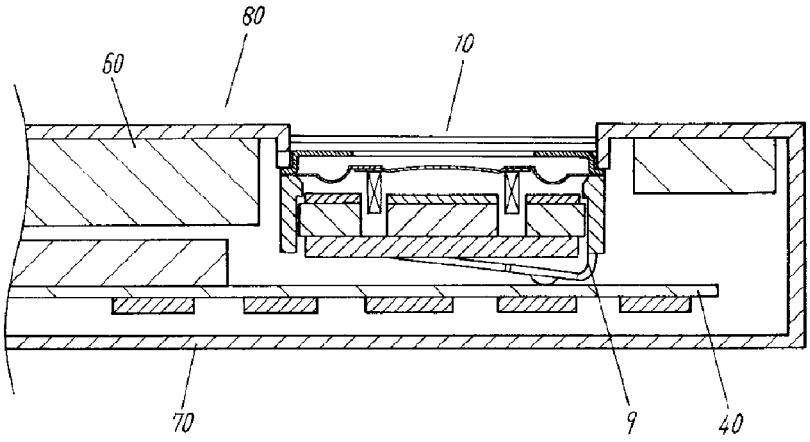
FIG. 12 is a sectional view of a principal part of a portable telephone in accordance with the exemplary embodiment of the present invention.

FIG. 6 is a sectional view in a short direction of the loudspeaker in accordance with the exemplary embodiment of the present invention. FIG. 7 is a sectional view in a longitudinal direction of the loudspeaker of the same exemplary embodiment. FIG. 8 is a top view of the loudspeaker in which a top plate is taken off from the magnetic circuit of the same exemplary embodiment. Furthermore, FIGS. 9 to 11 are sectional views in a short direction of other loudspeakers of the same exemplary embodiment. FIG. 12 is a sectional view of a principal part of a portable telephone as an electronic apparatus in accordance with the exemplary embodiment of the present invention.

As shown in FIGS. 4 to 7, in loudspeaker 10 of this exemplary embodiment, magnetic circuit 4 and diaphragm 7 are supported by frame 6. As shown in FIGS. 1, 6, and 7, magnetic circuit 4 includes bottom plate 3, first magnet 2A, first magnet 2B, second magnet 2C, first top plate 1A, and second top plate 1C. First magnets 2A and 2B constitute first magnetic portions, respectively. Second magnet 2C constitutes a second magnetic portion. Note here that the second magnetic portion may include second top plate 1C.

On bottom plate 3, first magnets 2A and 2B are disposed at the outer side of voice coil 8, and second magnet 2C is disposed at the inner side of voice coil 8. First magnets 2A and 2B and second magnet 2C are coupled to bottom plate 3. Annular first top plate 1A, which is disposed at the outer side of voice coil 8, is coupled to magnets 2A and 2B at the opposite side to bottom plate 3. Second top plate 1C, which is disposed at the inner side of voice coil 8, is coupled to second magnet 2C at the opposite side to bottom plate 3.

Each of three magnets 2A to 2C has a rectangular parallelepiped shape, having long sides and short sides, parallel to a surface of bottom plate 3 to which the magnets are coupled. One of the long sides of each of first magnets 2A and 2B is allowed to face each of the long sides of second magnet 2C, so that magnets 2A to 2C are arranged in parallel with a space interposed therebetween. Thus, long and narrow slim-shaped magnetic circuit 4 is formed. As a result, the space factor of magnetic circuit 4 can be improved and loudspeaker 10 can be made smaller and more compact.

When magnets 2A to 2C have a rectangular parallelepiped shape, a magnet such as a neodymium magnet that cannot easily be shaped can be easily molded into magnets 2A to 2C. Therefore, the production cost of magnets can be reduced.

Second top plate 1C has a rectangular shape (a rectangular parallelepiped shape having a small thickness) that is similar to the shape of magnet 2C. On the other hand, first top plate 1A has an annular shape including main bodies 101A and 201A each having a rectangular shape similar to the shape of each of first magnets 2A and 2B to which first top plate 1A is coupled, and portions for connecting main bodies 101A and 201A. Furthermore, portions for connecting between first magnets 2A and 2B of first top plate 1A are provided with bending portions 1Aa and 1Ab bending from main bodies 101A and 201A toward bottom plate 3.

Each of magnets 2A to 2C is magnetized in a direction (a first direction) in which bottom plate 3, first magnets 2A and 2B, and first top plate 1A are stacked. First magnets 2A and 2B are magnetized in the same direction. Second magnet 2C is magnetized in the opposite direction to the magnetization direction of first magnets 2A and 2B. For example, as shown in FIG. 6, in first magnets 2A and 2B, a bottom plate 3 side is magnetized to the N-pole, and a first top plate 1A side is magnetized to the S-pole. In second magnet 2C, a second top plate 1C side is magnetized to the N-pole, and a bottom plate 3 side is magnetized to the S-pole.

As shown in FIG. 6, magnetic gaps 5A and 5B are formed between the long sides of main bodies 101A and 201A of first top plate 1A and the long sides of second top plate 1C, respectively. Furthermore, as shown in FIG. 7, magnetic gaps 5C and 5D are formed between the short sides of second top plate 1C and bending portions 1Aa and 1Ab of first top plate 1A, respectively. Voice coil 8 is inserted into magnetic gaps 5A to 5D.

It is preferable that bending portions 1Aa and 1Ab of first top plate 1A include cut-away part 1Ac through which a lead wire of voice coil 8 is inserted to pass.

Frame 6 is coupled to magnetic circuit 4 configured above. Terminal 9 is coupled to frame 6 in advance. Diaphragm 7 supported by frame 6, and voice coil 8 fixed to diaphragm 7 and inserted into magnetic gaps 5A to 5D of magnetic circuit 4 constitute a loudspeaker.

With the above-mentioned configuration, a plurality of magnets 2A to 2C, each having long sides and short sides and being arranged such that the long sides face each other, form a noncircular-shaped magnetic circuit 4.

When magnets 2A to 2C having different magnetization directions are arranged in parallel, magnetic energy is added and the added magnetic energy acts on the magnetic gaps, so that the magnetic flux density is increased. Furthermore, magnetic energy from magnets 2A to 2C having different magnetization directions can be added also to magnetic gaps 5C and 5D, formed by the short sides of first top plate 1A, via bending portions 1Aa and 1Ab. Therefore, the magnetic utilization factor of the magnetic circuit can be improved to thus enhance a sound pressure level of the loudspeaker.

Furthermore, in magnetic gaps 5C and 5D, bending portions 1Aa and 1Ab are provided by binding a part of first top plate 1A at a right angle. That is to say, bending portions 1Aa and 1Ab bend at a right angle. Therefore, enlargement of the outside dimension of magnetic circuit 4 seen in the top view can be suppressed.

Note here that since magnetic gaps 5C and 5D are formed by using annular first top plate 1A at the same time when magnetic gaps 5A and 5B are formed, the number of components and production man-hours are not increased.

Furthermore, the magnetic pole width of magnetic gaps 5A and 5B is defined by the dimension in the first direction of first top plate 1A and second top plate 1C, while the magnetic pole width of magnetic gaps 5C and 5D is defined by the dimension in the first direction of bending portions 1Aa and 1Ab. Herein, it is preferable that the magnetic pole width of magnetic gaps 5C and 5D is made to be larger than those of magnetic gaps 5A and 5B. That is to say, it is preferable that the dimension of bending portions 1Aaand 1Ab in the first direction is larger than the dimension of second top plate 1C in the first direction. With this configuration, distribution of the magnetic flux density given to voice coil 8 in magnetic gaps 5C and 5D can be increased, so that the power linearity of the loudspeaker can be improved.

Furthermore, when bending portions 1Aa and 1Ab are provided with cut-away part 1Ac through which a lead wire of voice coil 8 is inserted to pass, the lead wire of voice coil 8 can be inserted to pass with improved workability. Furthermore, the lead wire is inserted to pass through cut-away part 1Ac and connected to terminal 9, reliably. Consequently, disconnection of the lead wire is suppressed, and quality is also improved. That is to say, improvement in productivity and stability of quality can be achieved. In addition, formation of cut-away part 1Ac through which the lead wire of voice coil 8 is inserted to pass enables the overall height of loudspeaker 10 to be reduced. Note here that it is desirable that cut-away part 1Ac be provided in two places so that two lead wires, that is, positive-side and negative-side lead wires of voice coil 8 can be inserted to pass.

Furthermore, cut-away part 1Ac may be provided in two places each in bending portions 1Aa and 1Ab, that is, may be provided in four places in total as shown in FIG. 1, for eliminating limitations in assembly on first top plate 1A and a drawing-out direction of a lead wire of voice coil 8 so as to improve the productivity. In this case, providing of many cut-away parts also can reduce material to be used and contribute reduction of weight.

Furthermore, as shown in FIG. 8, in magnetic circuit 4, dimension W2 of the long side of second magnet 2C at the inner side of voice coil 8 is set to be slightly smaller than dimension W1 of the long side of first magnets 2A and 2B at the outer side of voice coil 8. Such setting can enhance the efficiency with volumes of a plurality of magnets maximized and the outside dimension of magnetic circuit 4 minimized.

Furthermore, bending portions 1Aa and 1Ab can be used as a positioning guide for first magnets 2A and 2B. For example, when the dimension of the long side of second magnet 2C is smaller than that of first magnets 2A and 2B, bending portions 1Aa and 1Ab are brought into contact with the short sides of first magnets 2A and 2B so as to set the dimension of first magnets 2A and 2B. Only with such dimension setting, bending portions 1Aa and 1Ab can easily define the positions of the short sides as the positioning guide. In addition, when a projection, a dowel protrusion, or the like (not shown) as a positioning guide is provided to first top plate 1A and brought into contact with the long sides of first magnets 2A and 2B, the position of the long sides can be easily defined. With such a configuration, magnetic circuit 4 can be assembled without using a positioning jig. As a result, the productivity can be improved.

Furthermore, bottom plate 3 may be provided with a positioning guide (not shown) for first magnets 2A and 2B and second magnet 2C. As this positioning guide, when a projection, a dowel protrusion, or the like, is provided to bottom plate 3, the positions of first magnets 2A and 2B and second magnet 2C can be easily defined. With such a configuration, magnetic circuit 4 can be assembled without using a positioning jig. As a result, the productivity can be improved.

Note here that in order to further reduce the weight of magnetic circuit 4 and to improve the efficiency, the outside dimension of first top plate 1A in the direction in which magnets 2A to 2C are arranged may be made smaller than the dimension (outer dimension) from the outer side of first magnet 2A to the outer side of first magnet 2B in the same direction. With such a configuration, in response to the proportion at which the outside dimension of first top plate 1A is reduced, a volume of first top plate 1A can be reduced. Accordingly, the weight of magnetic circuit 4 can be reduced. Furthermore, reduction of the outside dimension of first top plate 1A can reduce a leakage flux toward the outside direction. Consequently, although the volume of first top plate 1A is reduced, a sound pressure level of loudspeaker 10 can be secured without reducing the magnetic flux density inside magnetic gaps 5A to 5D.

Furthermore, as another configuration for further reducing the weight of magnetic circuit 4 and improving magnetic efficiency, the outside dimension of bottom plate 3 in the direction in which magnets 2A to 2C are arranged may be smaller than the outer dimension of first magnets 2A and 2B in the same direction. With such a configuration, in response to the proportion at which the outside dimension of bottom plate 3 is reduced, a volume of bottom plate 3 can be reduced. Accordingly, the weight of magnetic circuit 4 can be reduced. Furthermore, reduction of the outside dimension of bottom plate 3 can reduce a leakage flux toward the outside direction. Consequently, although the volume of bottom plate 3 is reduced, the sound pressure level of loudspeaker 10 can be secured without reducing the magnetic flux density inside magnetic gaps 5A to 5D.

Furthermore, as shown in FIG. 9, at the inner side of voice coil 8, as a second magnet, second magnets 2D and 2E with a space provided therebetween may be arranged in parallel in a direction of in which first magnets 2A and 2B are arranged in parallel. In this case, the second magnetic portion includes second magnets 2D and 2E and second top plate 1C. With such a configuration, in response to the proportion of the provided space, volume of the second magnet can be reduced. Accordingly, the weight of magnetic circuit 4 can be reduced. By bringing second magnet 2D near to first magnet 2A, and second magnet 2E to first magnet 2B, it is possible to reduce magnetic gaps 5A and 5B and to improve the magnetic efficiency of magnetic circuit 4. Consequently, although the volume of the second magnet is reduced, a sound pressure level of loudspeaker 10A can be secured without reducing the magnetic flux density inside magnetic gaps 5A and 5B.

As shown in FIG. 10, as the second top plate at the inner side of voice coil 8, second top plate 1D and second top plate 1E with a space provided therebetween may be provided on second magnet 2C. In this case, the second magnetic portion includes second magnet 2C and second top plates 1D and 1E. With such a configuration, in response to the proportion of the provided space, a volume of the second top plate can be reduced. Accordingly, the weight of magnetic circuit 4 can be reduced. By bringing second top plate 1D and second top plate 1E near to first top plate 1A so as to reduce magnetic gaps 5A and 5B, it is possible to improve the efficiency of magnetic circuit 4. Consequently, although the volume of the second top plate is reduced, a sound pressure level of loudspeaker 10B can be secured without reducing the magnetic flux density inside magnetic gaps 5A and 5B. Note here that second upper plate may have an annular shape.

Furthermore, as shown in FIG. 11, second magnets 2D and 2E shown in FIG. 9 in this exemplary embodiment and second top plates 1D and 1E shown in FIG. 10 in this exemplary embodiment may be employed simultaneously. In this case, the second magnetic portion includes second magnets 2D and 2E and second top plates 1D and 1E. With such a configuration, in response to the proportion of the provided space, the volume of the magnet and the top plate can be reduced. Accordingly, the weight of magnetic circuit 4 can be further reduced. By disposing second magnets 2D and 2E and second top plates 1D and 1E such that magnetic gaps 5A and 5B are reduced in size, the efficiency of magnetic circuit 4 can be improved. Consequently, although the volume of the magnet and the second top plate is reduced, a sound pressure level of loudspeaker 10C can be secured without reducing the magnetic flux density inside the magnetic gaps.

Furthermore, in order to further reduce the weight of loudspeaker 10 and to improve the production efficiency, frame 6 may be made of resin, and magnetic circuit 4 may be integrally formed with frame 6 by insert-molding of the resin. In such a configuration, use of resin having a smaller specific gravity than metal can reduce the weight of loudspeaker 10. Formation of magnetic circuit 4 integrally with frame 6 by insert-molding can improve production efficiency.

Furthermore, when magnetic circuit 4 is integrally formed with frame 6 by insert-molding of resin, it is preferable that the outer periphery of first top plate 1A is integrally formed by insert-molding. Since insert-molding of only a part of first top plate 1A provided on the upper part of magnetic circuit 4 enables integral formation, an amount of resin to be used can be minimized. As a result, the weight of loudspeaker 10 can be further reduced.

Needless to say, in this case, also first magnets 2A and 2B may be insert-molded. In addition, also bottom plate 3 may be insert-molded. Insert-molding of first magnets 2A and 2B and bottom plate 3 in this way tends to increase an amount of resin to be used, thus making it difficult to reduce weight. However, binding force and binding reliability between frame 6 and magnetic circuit 4 can be further improved. These can be appropriately and freely selected with reference to the weight reduction of loudspeaker 10 and the binding force and the binding reliability between frame 6 and magnetic circuit 4.

Loudspeakers 10 to 10C are described above, in which a sound pressure level can be enhanced even when the loudspeaker is made smaller, more lightweight, and more compact, and reduction of cost can be achieved by reducing the number of components and improving the productivity. Next, a portable telephone or an electronic apparatus in which any one of the loudspeakers is mounted is described.

FIG. 12 is a sectional view of a principal part of a portable telephone as an electronic apparatus in accordance with the exemplary embodiment of the present invention. Any one of loudspeakers 10 to 10C is mounted on portable telephone 80. Hereinafter, an example in which loudspeaker 10 is mounted is described.

Portable telephone 80 includes components such as loudspeaker 10, electric circuit 40 including an amplifier for supplying loudspeaker 10 with an electric signal, and liquid crystal display 60, and includes exterior case 70 including the components inside thereof. Then, when terminal 9 and electric circuit 40 of loudspeaker 10 are brought into contact with each other, loudspeaker 10 is supplied with an electric signal output from the amplifier. Even when loudspeaker 10 is small, lightweight, and compact, it can achieve increase of a sound pressure level and reduction of cost, and has an effect of reducing a leakage flux from the magnetic circuit to the outside. Therefore, also in portable telephone 80 in which loudspeaker 10 is mounted, in addition to downsizing and weight reduction, improvement of a sound pressure level, reduction of cost, reduction of a leakage flux can be achieved.

Note here that an example in which an electronic apparatus is a portable telephone as a mobile communication apparatus is described, the electronic apparatus is not limited to this example. Examples of the electronic apparatus include a smartphone, a portable game machine, furthermore, video apparatuses such as portable navigation or television, and furthermore, personal computer. The example can include any electronic apparatuses in which a loudspeaker is mounted.

What is claimed is:

1. A loudspeaker comprising:

a magnetic circuit including:

a bottom plate, two first magnets arranged in parallel and coupled to the bottom plate, a second magnet disposed between the two first magnets and coupled to the bottom plate, and an annular first top plate provided to the two first magnetic portions at an opposite side to the bottom plate and disposed in such a manner as to form a magnetic gap with respect to the second magnet;

a frame supporting the magnetic circuit;

a diaphragm supported by the frame; and a voice coil fixed to the diaphragm and inserted into the magnetic gap of the magnetic circuit, wherein the two first magnets and the second magnet are magnetized in opposite directions to each other in a first direction in which the bottom plate, the two first magnets, and the first top plate are stacked, the first top plate includes two main bodies each of which is placed on one of the two first magnets, and two bending portions connecting between the two first magnets and bending toward the bottom plate from the main bodies, and the second magnet includes a second top plate disposed at an opposite side to the bottom plate, and each of the bending portions includes:

two first regions each of which faces one of the two first magnets;

two connecting portions each of which connects the main body to one of the two first regions;

a second region which faces the second magnet and protrudes toward the second top plate in the first direction, the second region extending in the first direction beyond an interface between the second magnet and the second top plate; and two cut-away parts each of which is formed between one of the two first regions and the second region.

2. The loudspeaker of claim 1, wherein each of the two first magnets and the second magnet includes a rectangular parallelepiped shaped magnet having long sides and short sides, and one of the long sides of the magnet included in each of the two first magnets and each of the long sides of the magnet included in the second magnet face each other.

3. The loudspeaker of claim 2, wherein the second magnet includes two magnets arranged in a parallel in a direction in which the two first magnets are arranged in parallel.

4. The loudspeaker of claim 2, wherein a dimension of each of the long sides of the second magnet is smaller than a dimension of each of the long sides of the two first magnets.

5. The loudspeaker of claim 2, wherein the first top plate includes a guide for positioning the two first magnets.

6. The loudspeaker of claim 2, wherein an outside dimension of the first top plate in the direction in which the two first magnets are arranged in parallel is smaller than an outer dimension of at least one of the two first magnets.

7. The loudspeaker of claim 2, wherein an outside dimension of the bottom plate in the direction in which the two first magnets are arranged in parallel is smaller than an outer dimension of at least one of the two first magnets.

8. The loudspeaker of claim 1, wherein the two bending portions bend at a right angle with respect to the two main bodies in the first top plate.

9. The loudspeaker of claim 1, wherein the two bending portions include a cut-away part through which a lead wire of the voice coil is inserted to pass.

10. The loudspeaker of claim 1, wherein the frame is made of resin and integrally formed with the magnetic circuit.

11. The loudspeaker of claim 1, wherein the frame is made of resin, and integrally formed with an outer periphery of the first top plate.

12. An electronic apparatus comprising:

the loudspeaker defined in claim 1, and an amplifier for supplying the loudspeaker with an electric signal.

13. The loudspeaker of claim 1, wherein:

a part of at least one of the two bending portions faces one the two first magnets, and a face where the bending portion faces the second magnet is larger than a face where the bending portion faces the one of the two first magnets.

14. The loudspeaker of claim 1, wherein the second magnet is configured with two magnets and a space therebetween.

15. The loudspeaker of claim 1, wherein the second top plate is configured with two plates and a space therebetween.

16. The loudspeaker of claim 15, wherein:

the second magnet is configured with two magnets and a space therebetween, and the two plates of the second top plate are formed on the two magnets of the second magnet.

* * * * *